US010793933B2

(12) United States Patent
Hind et al.

(10) Patent No.: US 10,793,933 B2
(45) Date of Patent: Oct. 6, 2020

(54) METHOD OF HEAT TREATMENT

(71) Applicant: ROLLS-ROYCE plc, London (GB)

(72) Inventors: Laura M. Hind, Keswich (GB); Vincent P. Tsao, Derby (GB); Callum J. Jackson, Aberdeen (GB); Daniel Clark, Derby (GB); Wai Lek Chan, Singapore (SG)

(73) Assignee: ROLLS-ROYCE PLC, London (GB)

( * ) Notice: Subject to any disclaimer, the term of this patent is extended or adjusted under 35 U.S.C. 154(b) by 322 days.

(21) Appl. No.: 15/846,856

(22) Filed: Dec. 19, 2017

(65) Prior Publication Data

US 2018/0187282 A1 Jul. 5, 2018

(30) Foreign Application Priority Data

Dec. 22, 2016 (GB) ..... 1621951.1

(51) Int. Cl.

| | |
|---|---|
| ***C21D 9/50*** | (2006.01) |
| ***C21D 9/00*** | (2006.01) |
| ***C21D 1/40*** | (2006.01) |
| ***H05B 3/58*** | (2006.01) |
| *H05B 3/14* | (2006.01) |
| *H05B 3/28* | (2006.01) |

(52) U.S. Cl.

CPC ..... *C21D 9/50* (2013.01); *C21D 1/40* (2013.01); *C21D 9/0006* (2013.01); *H05B 3/58* (2013.01); *C21D 2221/00* (2013.01); *C21D 2251/04* (2013.01); *H05B 3/141* (2013.01); *H05B 3/28* (2013.01)

(58) Field of Classification Search

CPC ..... C21D 9/50; C21D 1/40; C21D 9/0006; H05B 3/58

See application file for complete search history.

(56) References Cited

FOREIGN PATENT DOCUMENTS

| | | | | |
|---|---|---|---|---|
| CN | 204737991 | | 11/2015 | |
| CN | 204737991 U | * | 11/2015 | |
| WO | 2012103621 | | 8/2012 | |
| WO | WO-2012103621 A1 | * | 8/2012 | ..... C21D 9/50 |

OTHER PUBLICATIONS

Great Britain Search Report dated Jun. 28, 2017, issued in GB Patent Application No. 1621951.1.

Artech Services, Flexible Ceramic Pad Heaters, artechservices.co.uk., https://web.archive.org/web/*/http://www.artechservices.co.uk/flexible-ceramic-pad-heaters-p.htm, copy retrieved Jul. 13, 2020.

* cited by examiner

*Primary Examiner* — Jeremy Carroll

(74) *Attorney, Agent, or Firm* — Oliff PLC

(57) ABSTRACT

A method of heat treating a localised region of a component including providing a heat treatment assembly with two or more subassemblies. Each subassembly is configured to partially circumscribe a portion of the component for heat treatment. Each subassembly includes a housing configured to partially circumscribe a portion of the component. An insulator and a heater are provided within the housing and extend to partially circumscribe a component and are arranged such that the insulator is between a wall of the housing and the heater. The method includes positioning the subassemblies adjacently around the component so that the subassemblies fully circumscribe the component. The subassemblies are connected together. The method includes activating the heater to heat the component in a region adjacent the heater.

15 Claims, 7 Drawing Sheets

METHOD OF HEAT TREATMENT

CROSS-REFERENCE TO RELATED APPLICATION

This specification is based upon and claims the benefit of priority from UK Patent Application Number 1621951.1 filed on 22 Dec. 2016, the entire contents of which are incorporated herein by reference.

BACKGROUND

1. Field of the Disclosure

The present disclosure concerns a method of heat treating a localised region of a component, a method of manufacturing a component, and/or a heat treatment assembly.

2. Description of the Related Art

When components are welded together, particularly thick walled components such as those used for pressure vessels, the components often need to be heated before welding and/or the weld needs to be heat treated after welding, referred to as post weld heat treatment.

There are several methods of post weld heat treatment, depending on the diameter of the component being welded and subsequently heat treated. For smaller components, the weld is visually inspected and then thermocouples are manually attached to the weld region. Following this, a ceramic heat mat (often referred to as a flexible ceramic pad (FCP)) is wrapped around the weld region. Insulating material is then wrapped around the heat mat. Metallic banding is used to hold the heat mat and insulating material in position. The heat mat is then activated to apply the required heat to the weld region for the required period of time. Once heat treatment is complete, the banding, insulating material and heat mat are removed.

For larger components, it is not possible or it is difficult to wrap the heat mat, insulating material and banding around the component, so the weld region can be heated using either open gas flames to treat the component locally, or using a furnace to treat the entire component.

BRIEF SUMMARY

The described methods of post-weld heat treatment are time consuming and reliant on operator skill.

According to an aspect there is provided a method of heat treating a localised region of a component. The method comprises providing a heat treatment assembly comprising two or more subassemblies. Each subassembly is configured to partially circumscribe a portion of the component for heat treatment. Each subassembly comprises a housing. The housing may be configured to partially circumscribe a portion of the component. An insulator and a heater are provided within the housing. The heater and the insulator may extend to partially circumscribe a component. The insulator is arranged between a wall of the housing and the heater. The method comprises positioning the subassemblies adjacently around the component so that the subassemblies fully circumscribe the component. The subassemblies are connected together. The method includes activating the heater to heat the component in a region adjacent the heater.

The subassemblies may be connected along a generally longitudinally extending interface between the adjacent subassemblies.

The heater may comprise a ceramic mat.

The ceramic mat may comprise a plurality of tiles. The tiles may be arranged in rows, with the tiles of one row being offset from the tiles of an adjacent row.

The ceramic mat may be connected to the housing using a plurality of mechanical fixtures, for example a plurality of pins.

The ceramic mat may include a heating element extending through each of the tiles. The heating element may define a bend so as to extend from the mat at an angle substantially perpendicular to the rows of tiles. The heating element exiting the mat may be covered in beads of ceramic, and the beads at the bend may have a substantially 45 degree channel through which the heating element extends.

The heating element may be a wire.

Gaps may be provided in the mat. Thermocouples may be provided at a position corresponding with the gaps in the mat.

The housing may include one or more holes for receiving a thermocouple. The method may comprise positioning thermocouples through the holes to contact the component.

The thermocouples may be removably coupled to the housing. For example, the thermocouples may be connected to the housing using a bayonet connector.

The thermocouples may be sprung so as to improve contact of the thermocouples with the component.

The housing of each subassembly may define complimentary interlocking interfaces. The method may comprise, when the subassemblies are positioned adjacent each other, interlocking the complimentary interlocking interfaces of two adjacent subassemblies.

The complimentary interlocking interfaces may comprise protrusions and/or recesses. For example, one circumferential end of a housing may include a recess and the other circumferential end of the housing may include a protrusion, the protrusion of one housing being receivable in the recess of an adjacent housing.

The method may comprise clamping adjacent subassemblies together around the component.

The method may comprise providing a plurality of heat treatment assemblies, and positioning the heat treatment assemblies axially (or longitudinally) adjacent each other.

The method may comprise providing one or more insulation assemblies. Each insulation assembly may comprise two or more insulation subassemblies. Each insulation subassembly may be configured to partially circumscribe a portion of the component for heat treatment. Each insulation subassembly may comprise a housing configured to partially circumscribe a portion of the component, and an insulator provided within the housing and extending to partially circumscribe a component. The method may further comprise positioning the insulation subassemblies adjacently around the component so that the insulation subassemblies fully circumscribe the component and the insulator of each subassembly is proximal to the component.

The method may comprise providing a plurality of heat treatment assemblies, and positioning the one or more insulation assemblies adjacent one or more of the heat treatment assemblies.

The method may comprise using a positioning device to locate the heat treatment assembly and/or the insulation assembly relative to the component. The positioning device may be, for example a camera. The positioning device may be mounted to the housing of one or more of the subassemblies of the heat treatment assembly and/or the insulation assembly.

The heat treatment assembly may be cylindrical.

The heat treatment assembly may comprise two subassemblies, each defining substantially half of the heat treatment assembly.

The housing may comprise a flange. The flange may comprise connectors, e.g. lifting lugs, for ease of manipulation of the subassembly.

The housing may be made from metal.

The insulator may be a solid insulator. For example, the insulator may be machined, moulded or vacuum formed, and/or may be made from one or more pieces of solid insulator material.

The localised region for heat treatment may be a region of a weld.

The region of a weld may be treated post welding.

The component may be heat treated before welding, and the region of the weld that is heat treated may be the region of the component that will be welded to another component.

According to an aspect there is provided a method of manufacturing a component comprising heat treating a localised part of the component using the method according to any one of the previous claims.

The component may be a pressure vessel for a nuclear power plant.

The component may be a pipe.

According to an aspect there is provided a heat treatment assembly comprising two or more subassemblies, each subassembly configured to partially circumscribe a portion of a component for heat treatment. The assembly may comprise one or more connectors for connecting the subassemblies together. Each subassembly may comprise a housing configured to partially circumscribe a portion of a component, an insulator, and a heater provided within the housing and extending to partially circumscribe a component and arranged such that the insulator is between a wall of the housing and the heater. Each subassembly is configured such that the subassemblies are positionable adjacently so as to fully circumscribe a component.

According to an aspect there is provided a heat mat comprising a plurality of tiles; and a wire that extends through the tiles, and wherein the wire defines a substantially 90° bend, and two ceramic beads are provided in the region of the 90° bend, each of the two ceramic beads including a channel at 45° through which the wire can extend.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION OF THE DISCLOSURE

Figure 1:
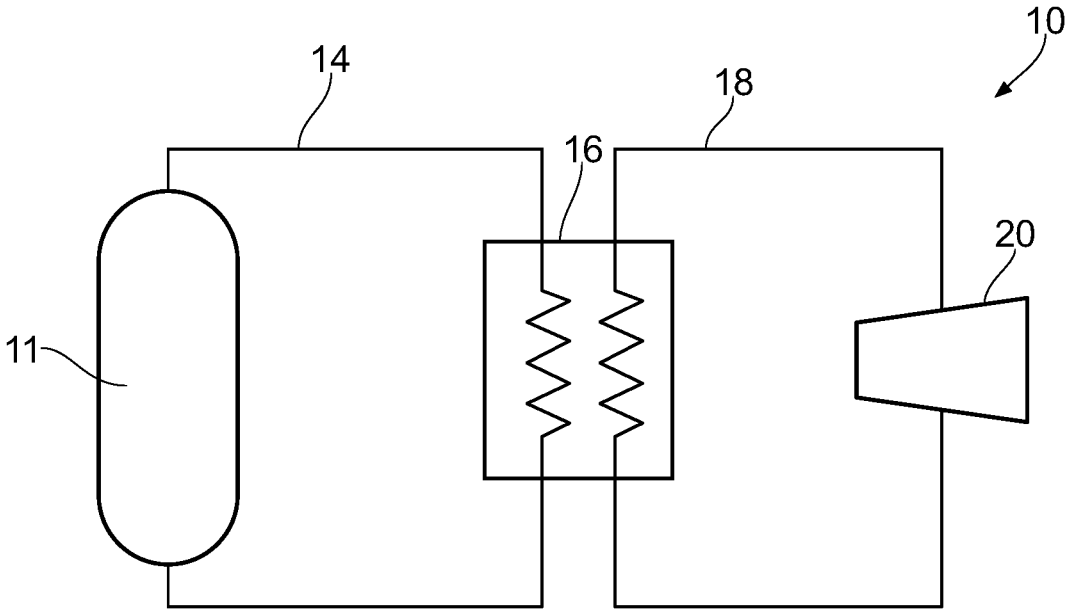
FIG. 1 is a schematic of a nuclear power plant.

Referring to FIG. 1, a nuclear power plant is indicated generally at 10. The plant includes a nuclear reactor 11, a primary circuit 14, a steam generator 16, a secondary circuit 18 and a turbine 20. The primary fluid in the primary circuit is heated by the nuclear reactor. The nuclear reactor includes a nuclear reactor vessel that houses nuclear fuel. The primary fluid then flows to the steam generator, where it heats secondary fluid in the secondary circuit. The heated secondary fluid is then used to drive the turbine 20.

Figure 2:
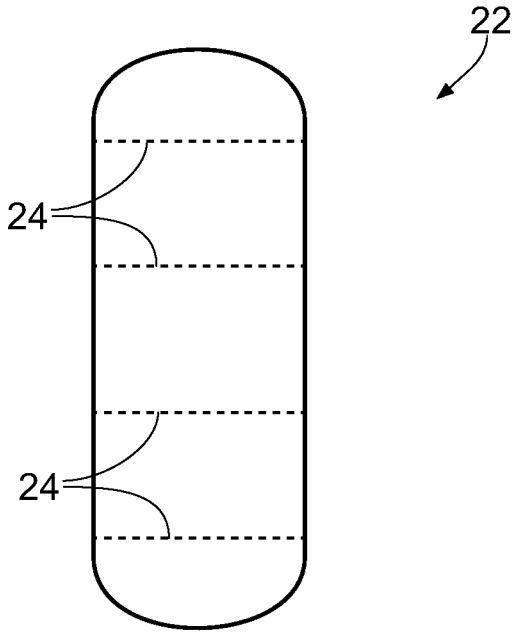
FIG. 2 is a schematic of a fabricated pressure vessel.

Referring to FIG. 2, pressure vessels 22 such as the reactor vessel or the steam generator vessel are often fabricated from a plurality of sections that are welded together, for example at the lines indicated at 24 in FIG. 2. Before and/or after welding (i.e. pre-weld or post-weld) the weld region needs to be heat treated. Before welding, the weld region is considered to be the ends of the sections that are to be welded together, and after welding, the weld region is considered to be the weld itself and the surrounding area. The area that needs heat treating is understood in the art so will not be described further here.

Figure 3:
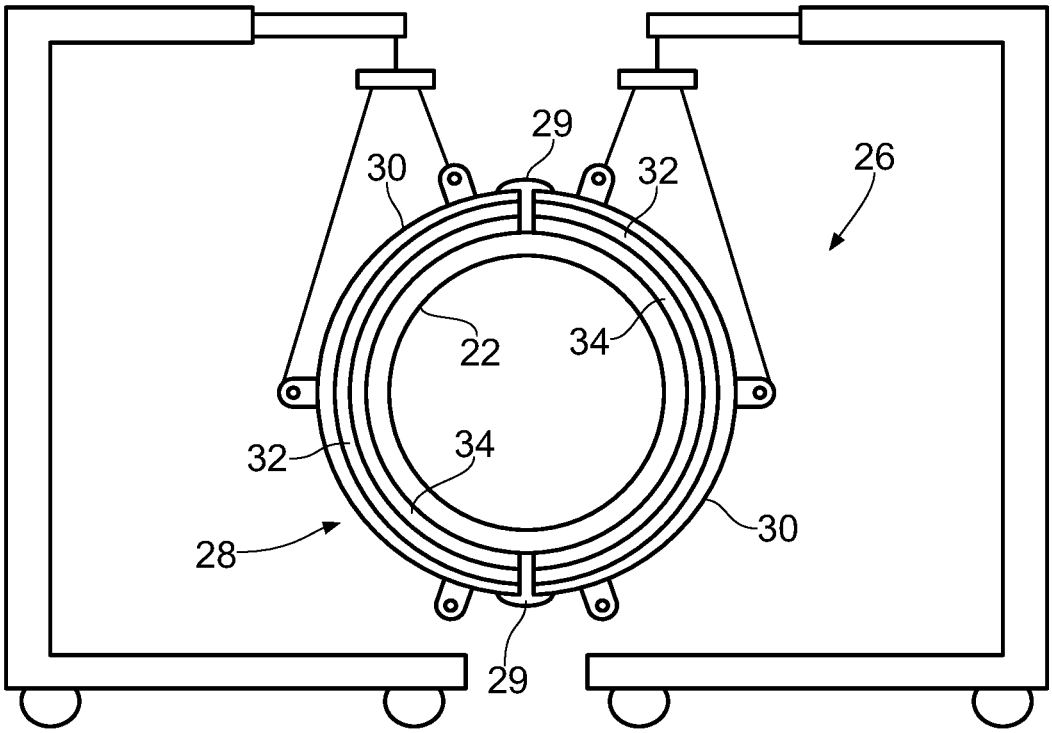
FIG. 3 is a schematic end view of a heat treatment assembly positioned around a weld region of the pressure vessel of FIG. 2.

Referring now to FIG. 3, a heat treatment arrangement is indicated generally at 26. The heat treatment arrangement includes one or more heat treatment assemblies 28 that include subassemblies 30. The subassemblies are positionable circumferentially adjacent each other and are arranged so that when they are adjacent they can fully circumscribe a component such as the previously described pressure vessel. In the present example, the pressure vessels have a substantially circular cross section, and as such the heat treatment assembly substantially defines a cylinder, with each sub assembly substantially defining a hemi-cylinder. The subassemblies are connected together, for example they may be connected using a clamp 29.

Figure 4:
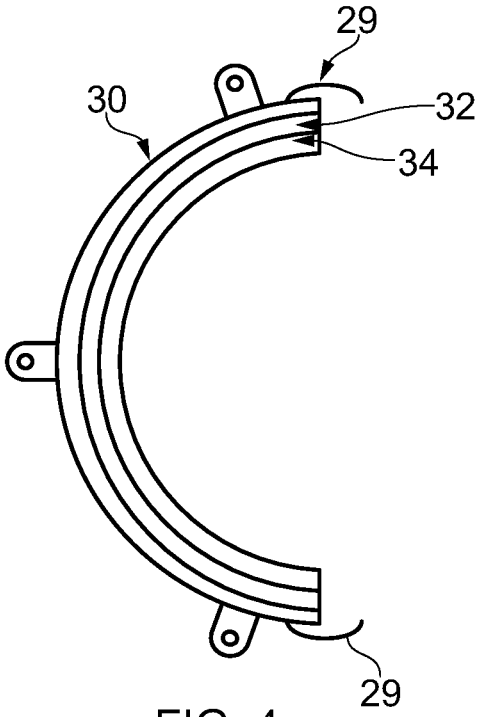
FIG. 4 is schematic end view of a subassembly of the heat treatment assembly of FIG. 3.

Referring to FIGS. 3 and 4, each sub assembly includes a housing 30, an insulator 32, and a heater 34. The insulator and heater are housed within the housing 30, with the heater being provided at a position that in use is proximal to the component to be heat treated, and the insulator being provided between the housing and the heater. As will be described later, thermocouples (not shown in FIGS. 3 and 4) may be provided for monitoring the temperature of a component being heat treated.

Figure 5:
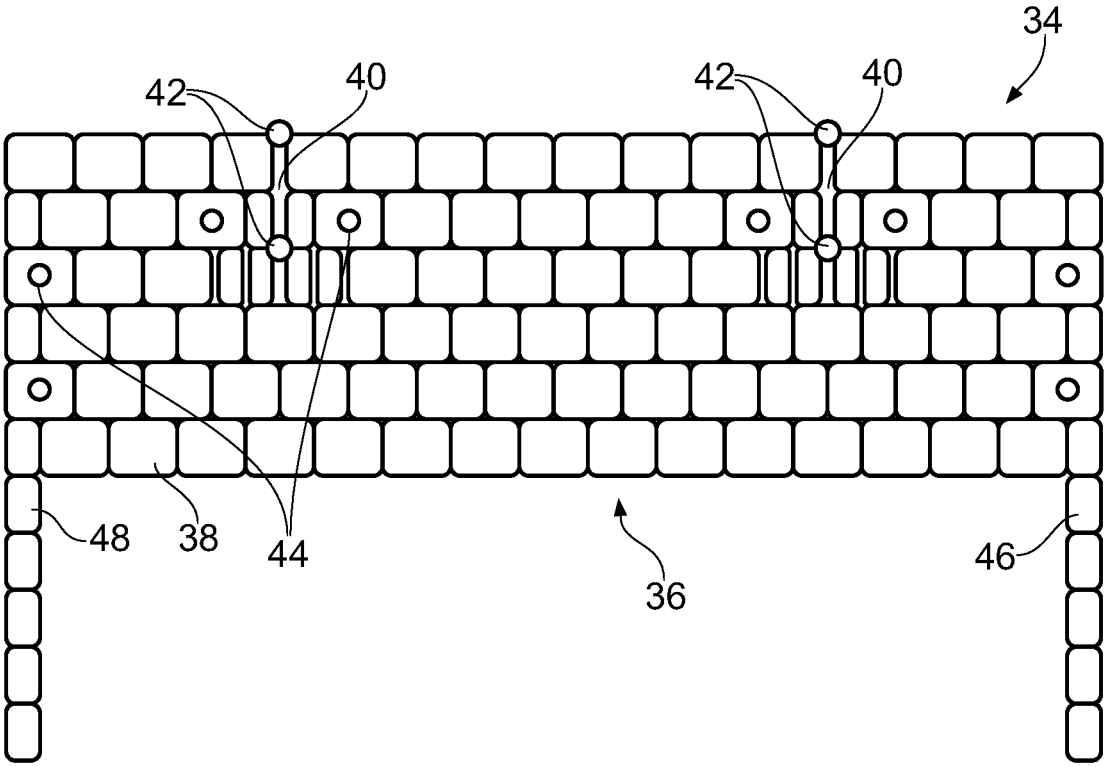
FIG. 5 is schematic plan view of a heater of the subassembly of FIG. 4.

Referring now to FIG. 5, in the present example, the heater 34 includes a ceramic mat 36. The ceramic mat includes a plurality of tiles 38. The tiles 38 are arranged in rows. The tiles of adjacent rows are offset from each other, to improve heat distribution. A heating element, for example a wire, extends through each of the tiles. The heating element in this example is a resistive heating element. The mat works in a similar way to conventional ceramic mats so will not be described further here.

The heater 34 is provided with slots 40. The slots 40 are provided at locations where thermocouples may be provided to monitor the temperature of a component. For example, a thermocouple may be provided at one or more of the locations indicated at 42 in FIG. 5.

The heater 34 is connected to the insulator 32 and optionally also the housing 30 using a connector, for example a mechanical connector. In this example, the heater 34 is connected by pins 44 that pin selected tiles to the insulator and in this case also the housing. An alternative mechanical connector may be a split pin.

The heater 34 includes two tails 46 that extend from the ceramic mat 36, but are not intended for heating. The heating element that passes through the ceramic tiles 38 of the ceramic mat extends through ceramic beads 48 of the tails for connection with, for example, an electrical source. For ease of illustration the tails are shown in FIG. 5 as being in the same plane as the mat, but when the subassembly is assembled, the tails extend perpendicularly to the mat in a plane that is perpendicular to the plane of the mat as illustrated in FIG. 5. Once assembled, the ceramic mat will be (in the described example) arcuate, and the tails will extend radially from the arc, for example, radially outwardly towards and through the insulator and the housing.

The heating element that extends through the mat is bent to define a substantially 90° bend. Provision of a 90° bend means that the heating element, and therefore the tail, can exit from the ceramic mat at a more compact angle and/or with more ease than would be possible with conventional ceramic mat arrangements. Compact design is important because, as will be described later, heat treatment assemblies may be positioned axially adjacent to each other.

Figure 6:
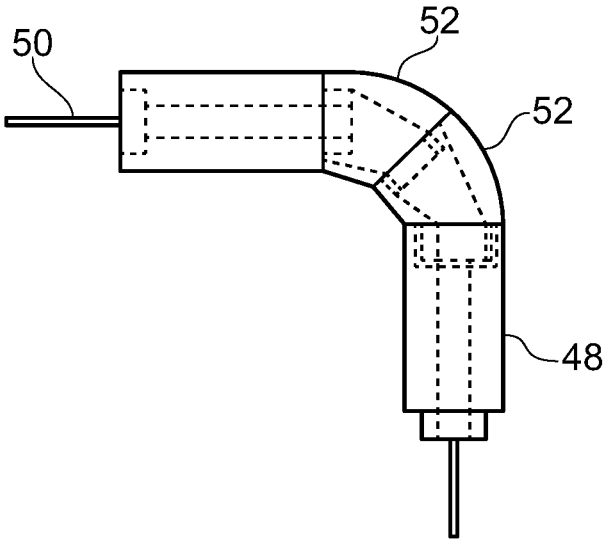
FIG. 6 is a schematic side view of a heating element and ceramic beads of the heater of FIG. 5.

Referring to FIG. 6, the heating element is a wire 50. To permit the wire to bend through 90° two ceramic corner beads 52 are provided. The corner beads define a 45° path for the wire, and the provision of the two beads adjacent to each other permits the wire to bend through 90°.

Now referring back to FIG. 4, in the present example, the insulator 32 is made from a block of insulation material. The insulator in the present example is made from a single piece of insulating material, but in alternative embodiments the insulator may be made from multiple pieces of insulating material. The insulating material may be vacuum formed, moulded or machined to the desired shape. In the present example, the insulator defines a hemi-cylinder. A radially outer surface of the insulator abuts a radially inner surface of the housing 30 and a radially inner surface of the insulator abuts a radially outer surface of the heater 34. Holes (not shown in FIG. 4) are provided in the insulator through which thermocouples can be received. Holes are also provided in the insulator for receiving the tails of the heater.

Figure 7:
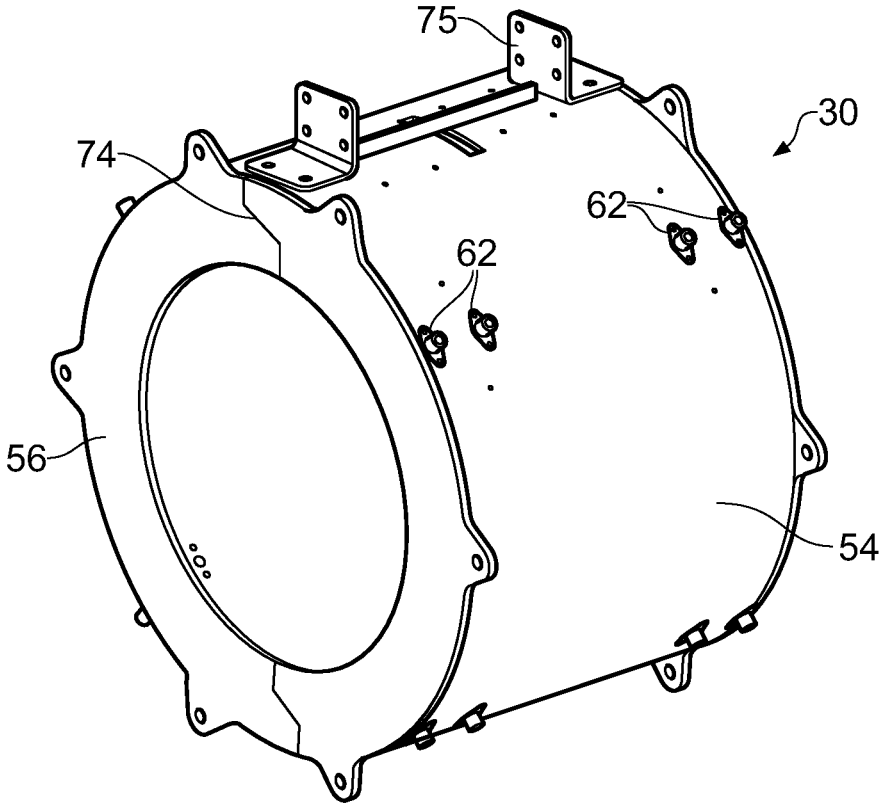
FIG. 7 is schematic perspective view of a housing of the subassembly of FIG. 3.
Figure 8:
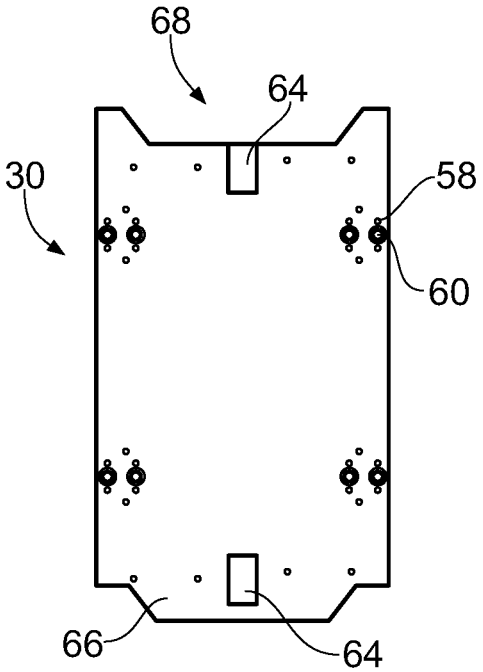
FIG. 8 is a schematic plan view of a body of the housing of FIG. 7 before the body is formed into a substantially hemi-cylindrical shape.
Figure 9:
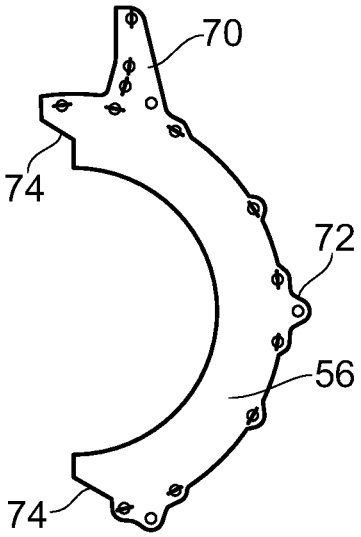
FIG. 9 is a schematic front view of a flange of the housing of FIG. 7.

Referring now to FIGS. 7 to 9, the housing 30 will be described in more detail. The housing has a body 54 that generally defines a hemi-cylinder. A flange 56 is provided at each longitudinal end of the body.

The body 54 includes holes 58 for receiving mechanical fasteners, e.g. pins, that are used to attach the heater and/or the insulator to the housing. The body further includes holes 60 for receiving a thermocouple. Connector members, e.g. bushes 62, are positioned on a radially outer surface of the body and surround the holes 60. The bushes are provided as a connector for the thermocouples, which will be described later. In this example, the bushes are bayonet bushes. The body also includes holes 64 each for receiving one or more tails from the heater.

At each circumferential end of the body 54, there is provided complimentary interlocking features. In the present example, a protrusion 66 is provided at one end and a recess 68 is provided at an opposite end. The shape and size of the protrusion and recess are complimentary. When the housing of one subassembly is positioned adjacent a housing of another subassembly, the protrusion of one of the subassemblies will be received in the recess of the other subassembly such that the subassemblies are interlocked.

The flanges 56 are provided with lugs 70, 72 for lifting and manipulating the subassembly. Circumferential ends of the body include interlocking features 74. The interlocking features 74 are shaped to include a protruded portion and a recessed portion, and are shaped and dimensioned such that a protrusion of an interlocking feature of one sub assembly is received in the recess of an interlocking feature of a circumferentially adjacent sub assembly.

Brackets 75 may be provided on the housing for mounting equipment such as a position monitor. The position monitor may be a camera, or may be some other positional device such as a laser positioner.

Figure 10:
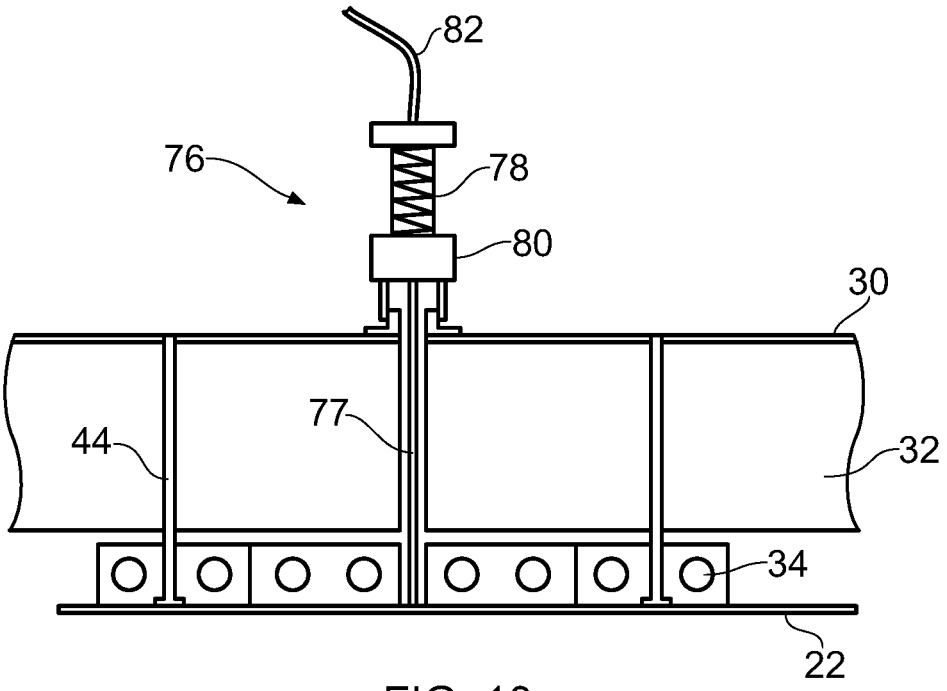
FIG. 10 is a schematic cross sectional view through a section of the subassembly of FIG. 3 in the region of a thermocouple.

Referring now to FIG. 10, thermocouples 76 are provided for monitoring the temperature of a component being heat treated. The thermocouple includes a probe 77 for contacting the component, and the probe 77 is slidable relative to a housing of the thermocouple and is sprung loaded via a spring 78, such that contact between the thermocouple and the component is more reliable. The thermocouple 76 is connected to the bush 62 of the housing, in this example the thermocouple is connected via a bayonet type fastening 80. The thermocouple is connected to monitoring equipment, for example via a connection 82, e.g. a wire or cable.

Figure 11:
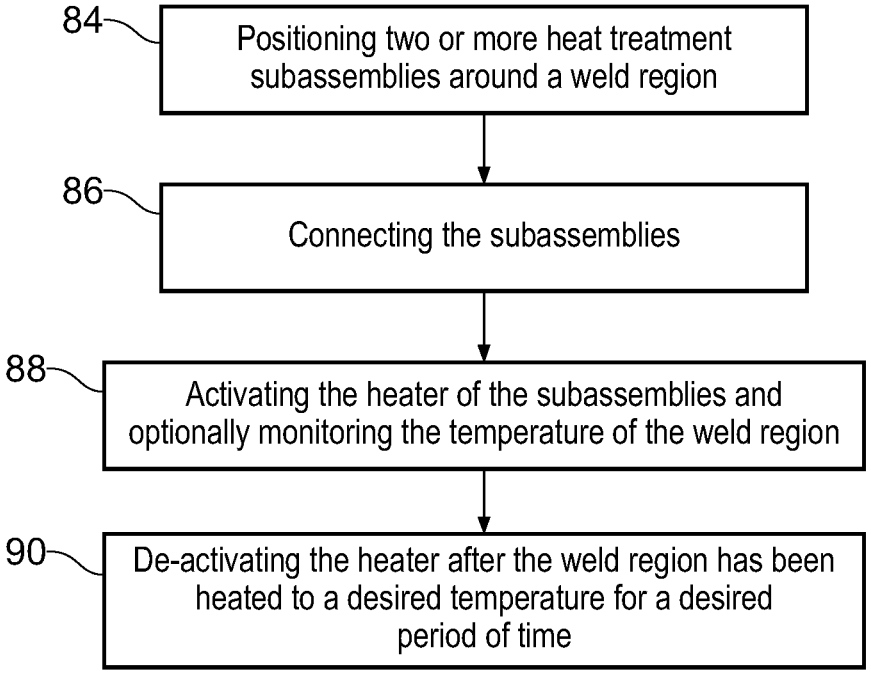
FIG. 11 is a flow diagram of a method of heat treating a component using the heat treatment assembly of FIG. 2.

Referring now to FIG. 11, a method of heat treating the weld region of a component will be described. As indicated in block 84, the subassemblies, in this case two subassemblies, are positioned around the weld region (in this example the weld region of the pressure vessel sections) so as to fully circumscribe the pressure vessel. In examples where a positioning device, such as a camera, is mounted to the housing, the positioning device can be used to correctly locate the subassembly. For example, when a camera is used, the camera may be connected to a screen that displays an image seen by the camera so as to guide an operator, alternatively the positioning may be automated.

Once the subassemblies are in position, the subassemblies are connected together using the clamp, as indicated in block 86. Once the subassemblies are positioned and connected, the heater is activated, as indicated at block 88. The heater is designed to heat to a desired temperature or temperature range. The temperature may be fixed or it may be variable using methods known in the art. Optionally, as in this example, thermocouples may be provided, and the thermocouples may be used to monitor the temperature of the weld region. Indeed in many examples monitoring of the temperature is necessary to meet regulatory standards. Once the weld region has been heated as desired, the heater is deactivated, as indicated at block 90. The subassemblies can then be disconnected and removed from the component (i.e. the vessel 22).

Figure 12:
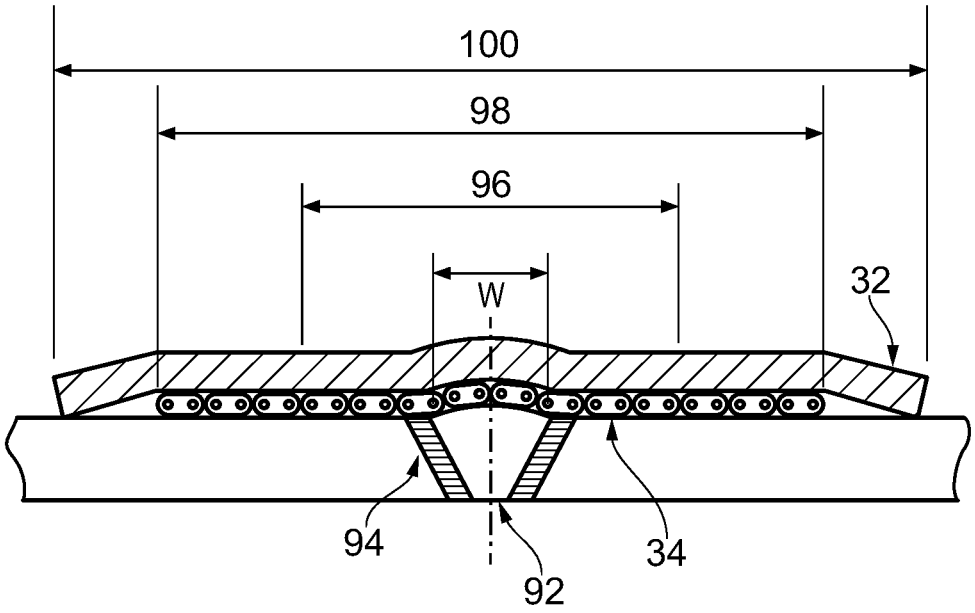
FIG. 12 is schematic sectional view of a weld region of a component with a heater and insulator of the subassembly of FIG. 3.

Referring to FIG. 12, as is known in the art, a weld will have a weld 92 and a heat affected zone 94 surrounding the weld. When the weld region is heat treated, an area indicated at 96 and often referred to as the soak control band is heated to a predetermined temperature. The soak control band 96 extends the width W of the weld 92 and across the heat affected zone 94. Heating is required across a larger area than the soak control band, and this area is referred to as the heat control band 98 which in practice extends the width of the heat mat 34. Often it is desirable for the heating of the weld region to be controlled outside of the heat control band, and this can be achieved by the insulator 32 extending beyond the heat mat to define a gradient control band 100. The extent of the bands of heating depends upon the heat treatment required and the depth of the weld/thickness of the component. To achieve these bands of heating, in the present example the heater 34 has a shorter axial length than the insulator 32, as illustrated in FIG. 11.

Figure 13:
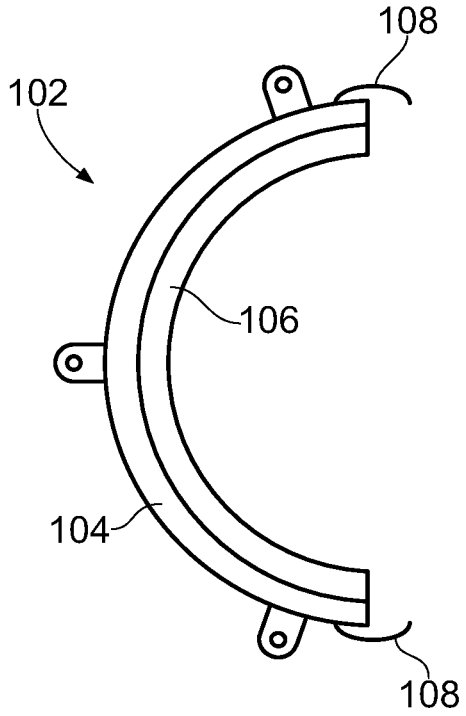
FIG. 13 is a schematic end view of an insulation subassembly.

However, to achieve the desired temperature gradient, in addition to or as an alternative to the insulator having a larger axial length than the heater, insulation assemblies may be provided. Referring to FIG. 13, the insulation assemblies are similar to the heat treatment assemblies, but no heater is provided. In this example, no thermocouples are provided either. The insulation assemblies include two or more subassemblies 102. In this example two subassemblies 102 are provided and each subassembly substantially defines a hemicylinder. Each subassembly includes a housing 104, which is similar to the housing 30 of the heat treatment subassemblies. Each subassembly further includes an insulator 106 which is connected to and housed in the housing 104. The insulator 106 is arranged so that it is proximal to the component to be treated. Accordingly, in this example, the insulator of the insulation subassembly is thicker than the insulator of the heat treatment subassembly. The subassemblies are positionable around the weld region and connectable using clamps 108, similar to the heat treatment assemblies.

Figure 14:
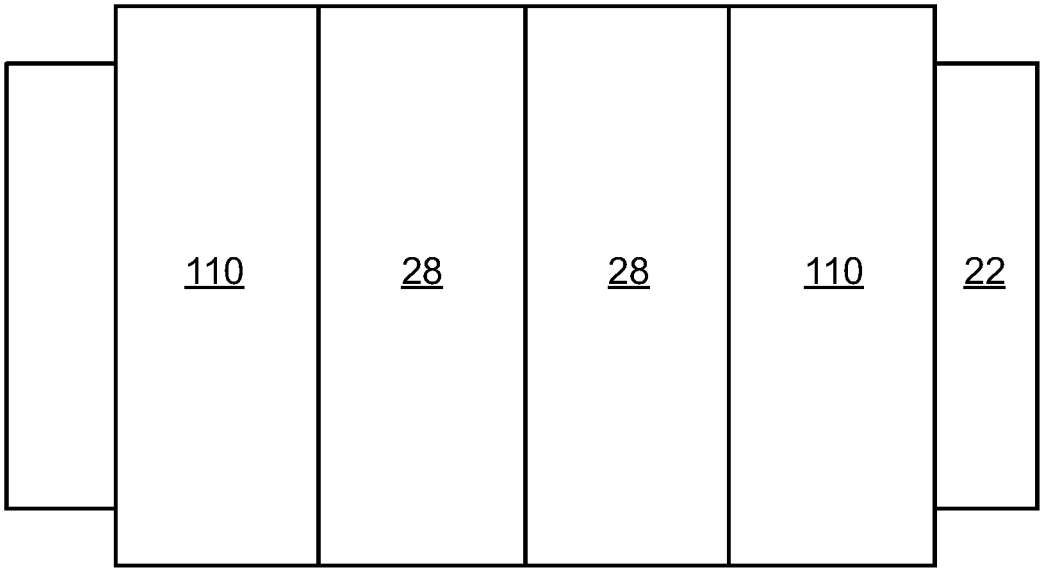
FIG. 14 is a schematic side view of a heat treatment arrangement having a plurality of heat treatment assemblies of FIG. 2 and insulation assemblies having insulation subassemblies of FIG. 13.

Referring to FIG. 14, the heat treatment assemblies and the insulation assemblies can be arranged to achieve the desired heat treatment of a component. In the present example, two heat treatment assemblies 28 are positioned proximal to the weld region, and an insulation assembly 110 (including the subassemblies 102 previously described) is positioned axially adjacent the two heat treatment assemblies on either axial side of the weld region.

The described method and heat treatment assemblies mean that heat treatment of a local region of a component, for example a weld region can be simplified.

The heat treatment assemblies, which may be considered to be modules, are easier to install at a given position with reduced operator involvement, compared to comparable local heat treatment methods of the prior art. The heat treatment assemblies can be positioned axially adjacent to each other so to accommodate heat treatment of components with varying wall thicknesses. The heat treatment assemblies can also be used for pre-weld heating of components as well as post-weld heat treatment, with no modification to the assemblies. The heat treatment assemblies and described method are capable of providing more reliable and consistent heat treatment.

The use of sliding and sprung thermocouples reduces the risk of damage to the thermocouples during assembly. The thermocouples are received through holes in the housing, insulator and slots in the heater and connected using a mechanical fastener, which reduces the amount of operator time and skill required to attach the thermocouples, compared with conventional weld heat treatment methods.

The heat treatment and insulation subassemblies have been described as being hemi-cylindrical, but it will be appreciated that they can have any suitable shape, depending on the number of subassemblies provided and the shape of the component to be treated.

The heat treatment assemblies and insulation assemblies have been described for use in heat treating a weld region of a pressure vessel for a nuclear power plant, but it will be appreciated by the person skilled in the art that the described heat treatment method and assemblies can be used on any component requiring localised heat treatment, in particular in the region of weld, for example other pressure vessels or thick walled pipes.

The described heating element is a resistive heating element, but alternative heating elements may be used. For example the heating element may be an induction heater. The heater is described as having a heating element and ceramic tiles to define a heat mat, but an alternative arrangement of heater or heat mat may be used.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of heat treating a localised region of a component, the method comprising:

providing a heat treatment assembly comprising two or more subassemblies, each subassembly configured to partially circumscribe a portion of the component for heat treatment, and each subassembly comprising a housing configured to partially circumscribe a portion of the component, an insulator and a heater provided within the housing and extending to partially circumscribe the component and arranged such that the insulator is between a wall of the housing and the heater, the housing including a hole configured to receive a thermocouple;

positioning the subassemblies adjacently around the component so that the subassemblies fully circumscribe the component;

connecting the subassemblies together;

positioning the thermocouple through the hole of the housing of one of the two or more subassemblies to contact the component; and activating the heater to heat the component in a region adjacent the heater, wherein the heater comprises a ceramic mat with a plurality of tiles, the tiles being arranged in rows, with the tiles of one row being offset from the tiles of an adjacent row.

2. The method according to claim 1, wherein the ceramic mat includes a heating element extending through each of the tiles, and wherein the heating element defines a bend so as to extend from the mat at an angle substantially perpendicular to the rows of tiles, and wherein the heating element exiting the mat is covered in beads of ceramic, the beads at the bend having a substantially 45 degree channel through which the heating element extends.

3. The method according to claim 1, wherein the thermocouple is removably coupled to the housing.

4. The method according to claim 1, wherein the housing of each subassembly defines complimentary interlocking interfaces, and the method comprises, when the subassemblies are positioned adjacent each other, interlocking the complimentary interlocking interfaces of two adjacent subassemblies.

5. The method according to claim 1, comprising clamping adjacent subassemblies together around the component.

6. The method according to claim 1, comprising providing a plurality of heat treatment assemblies, and positioning the heat treatment assemblies axially or longitudinally adjacent each other.

7. The method according to claim 1, the method comprising providing one or more insulation assemblies, each insulation assembly comprising two or more insulation subassemblies, each insulation subassembly being configured to partially circumscribe a portion of the component for heat treatment, and each insulation subassembly comprising a housing configured to partially circumscribe a portion of the component, an insulator provided within the housing and extending to partially circumscribe a component, the method further comprising positioning the insulation subassemblies adjacently around the component so that the insulation subassemblies fully circumscribe the component and the insulator of each assembly is proximal to the component.

8. The method according to claim 7, comprising providing a plurality of heat treatment assemblies, and positioning the one or more insulation assemblies adjacent one or more of the heat treatment assemblies.

9. The method according to claim 1, wherein the localised region for heat treatment is a region of a weld.

10. The method according to claim 9, wherein the region of the weld is treated post welding.

11. The method according to claim 9, wherein the component is heat treated before welding, and the region of the weld that is heat treated is the region of the component that will be welded to another component.

12. The method according to claim 1, wherein the component is a pressure vessel for a nuclear power plant.

13. A method of heat treating a localised region of a component, the method comprising:

providing a heat treatment assembly comprising two or more subassemblies, each subassembly configured to partially circumscribe a portion of the component for heat treatment, and each subassembly comprising a housing including a plurality of holes and configured to partially circumscribe a portion of the component, an insulator and a heater provided within the housing and extending to partially circumscribe the component and arranged such that the insulator is between a wall of the housing and the heater, the housing including a hole configured to receive a thermocouple;

positioning the subassemblies adjacently around the component so that the subassemblies fully circumscribe the component;

connecting the subassemblies together;

positioning a respective thermocouple in each of the plurality of holes to contact the component; and activating the heater to heat the component in a region adjacent the heater.

14. A method of heat treating a localised region of a component, the method comprising:

providing a heat treatment assembly comprising two or more subassemblies, each subassembly configured to partially circumscribe a portion of the component for heat treatment, and each subassembly comprising a housing configured to partially circumscribe a portion of the component, an insulator and a heater provided within the housing and extending to partially circumscribe the component and arranged such that the insulator is between a wall of the housing and the heater, the housing including a hole configured to receive a thermocouple;

positioning the subassemblies adjacently around the component so that the subassemblies fully circumscribe the component;

connecting the subassemblies together;

positioning the thermocouple through the hole of the housing of one of the two or more subassemblies to contact the component; and activating the heater to heat the component in a region adjacent the heater, wherein the thermocouple is sprung so as to improve contact of the thermocouple with the component.

15. A heat treatment assembly comprising:

two or more subassemblies, each subassembly configured to partially circumscribe a portion of a component for heat treatment, and one or more connectors for connecting the subassemblies together, wherein each subassembly comprises:

a housing configured to partially circumscribe a portion of the component and including a hole configured to receive a thermocouple;

a thermocouple positioned through the hole to contact the component, and an insulator and a heater provided within the housing and extending to partially circumscribe the component and arranged such that the insulator is between a wall of the housing and the heater, the heater comprising a ceramic mat with a plurality of tiles arranged in rows, with the tiles of one row being offset from the tiles of an adjacent row, wherein each subassembly is configured such that the subassemblies are positionable adjacently so as to fully circumscribe the component.

* * * * *